US010283889B2

(12) United States Patent
Glick et al.

(10) Patent No.: US 10,283,889 B2
(45) Date of Patent: May 7, 2019

(54) ELECTRICAL TERMINAL WITH BALANCED FRONT END PROTECTION

(71) Applicant: Lear Corporation, Southfield, MI (US)

(72) Inventors: Michael Glick, Farmington Hills, MI (US); Deborah Probert, Farmington Hills, MI (US); David Menzies, Linden, MI (US); Michael James Porter, Traverse City, MI (US)

(73) Assignee: Lear Corporation, Southfield, MI (US)

( * ) Notice: Subject to any disclaimer, the term of this patent is extended or adjusted under 35 U.S.C. 154(b) by 27 days.

(21) Appl. No.: 15/704,086

(22) Filed: Sep. 14, 2017

(65) Prior Publication Data

US 2019/0081425 A1 Mar. 14, 2019

(51) Int. Cl.

| | |
|---|---|
| ***H01R 13/187*** | (2006.01) |
| ***H01R 13/11*** | (2006.01) |
| ***H01R 13/05*** | (2006.01) |
| ***H01R 13/18*** | (2006.01) |

(52) U.S. Cl.

CPC ..... *H01R 13/187* (2013.01); *H01R 13/05* (2013.01); *H01R 13/11* (2013.01); *H01R 13/113* (2013.01); *H01R 13/18* (2013.01)

(58) Field of Classification Search

CPC ..... H01R 13/187; H01R 13/05; H01R 13/11; H01R 13/18

USPC ..... 439/843

See application file for complete search history.

(56) References Cited

U.S. PATENT DOCUMENTS

| | | | | |
|---|---|---|---|---|
| 5,338,229 | A | 8/1994 | Egenolf | |
| 5,868,590 | A * | 2/1999 | Dobbelaere | H01R 13/18 439/839 |
| 7,892,050 | B2 * | 2/2011 | Pavlovic | H01R 9/245 439/250 |
| 9,293,852 | B2 * | 3/2016 | Glick | H01R 43/20 |
| 9,548,553 | B2 | 1/2017 | Glick et al. | |
| 9,905,953 | B1 * | 2/2018 | Pavlovic | H01R 13/187 |
| 2004/0116002 | A1 | 6/2004 | Rozet et al. | |
| 2011/0076901 | A1 * | 3/2011 | Glick | H01R 9/245 439/839 |
| 2012/0129407 | A1 * | 5/2012 | Glick | H01R 13/113 439/817 |
| 2014/0273659 | A1 | 9/2014 | Glick et al. | |
| 2015/0038000 | A1 * | 2/2015 | Glick | H01R 13/113 439/370 |
| 2015/0038024 | A1 * | 2/2015 | Glick | H01R 13/18 439/862 |
| 2015/0079859 | A1 | 3/2015 | Glick et al. | |

* cited by examiner

*Primary Examiner* — Harshad C Patel

(74) *Attorney, Agent, or Firm* — MacMillan, Sobanski & Todd, LLC

(57) ABSTRACT

An electrical terminal includes a contact member. The contact member includes a contact base. The contact member includes a plurality of contact arms extending from the contact base. The contact arms are arranged on opposed sides of a terminal plane. The electrical terminal also includes a spring member. The spring member includes a spring base. The spring member includes a plurality of spring arms. The spring arms extend from the spring base. Each of the spring arms engages one or more of the contact arms. The spring member also includes a shroud. The shroud is connected to the spring base and extends around the contact arms and beyond the contact arms. The spring member is symmetrical across the terminal plane.

19 Claims, 6 Drawing Sheets

ELECTRICAL TERMINAL WITH BALANCED FRONT END PROTECTION

BACKGROUND OF THE INVENTION

This invention relates in general to a female electrical terminal with an assist spring. More specifically, this invention relates to a female electrical terminal with an assist spring that includes front end protection.

Electrical terminals commonly include a female terminal and a corresponding male terminal that may be mated to establish an electrical connection. Male electrical terminals are manufactured in various shapes, including pins and blades, and female electrical terminals are manufactured in complementary shapes that can engage the appropriate male terminal. Female terminals often include a contact portion with multiple contact arms that press onto sides of the male terminal. It is known to provide a female terminal with a spring member to increase the compression force between the male terminal and the female terminal. An example of one such spring is shown in U.S. Pat. No. 7,892,050. The spring member is typically made of a material that, compared to the material of the contact portion, has inferior electrical conductivity but is less susceptible to relaxation. The spring maintains the desired compression force without requiring that the size of the contact portion be increased and allows the female terminal to maintain a desired contact area with the male terminal, even when the temperature of the female terminal increases.

It is also known to provide a female terminal with front end protection. An example of front end protection is shown in U.S. Pat. No. 9,548,553. The terminal shown in the '553 patent includes a spring member with integral front end protection. The spring engages contact arms to maintain a compression force between the female terminal and a corresponding male terminal, similar to the spring member described in the '050 patent. Additionally, the spring member includes a cage that extends around and past the contact arms. The cage protects the contact arms from damage during shipping, handling, installation, and use. Because the cage is part of the spring member, no additional pieces are added to the female terminal. It would be desirable to have an improved female terminal with front end protection.

SUMMARY OF THE INVENTION

This invention relates to an electrical terminal. The electrical terminal includes a contact member. The contact member includes a contact base. The contact member includes a plurality of contact arms extending from the contact base. The contact arms are arranged on opposed sides of a terminal plane. The electrical terminal also includes a spring member. The spring member includes a spring base. The spring member includes a plurality of spring arms. The spring arms extend from the spring base. Each of the spring arms engages one or more of the contact arms. The spring member also includes a shroud. The shroud is connected to the spring base and extends around the contact arms and beyond the contact arms. The spring member is symmetrical across the terminal plane.

In another embodiment, this invention relates to an electrical terminal including a contact base and a plurality of contact arms extending from the contact base and arranged on opposed sides of a terminal plane. The electrical terminal also includes a spring member with a spring base and a plurality of spring arms extending from the spring base. Each of the spring arms engages one or more of the contact arms. A shroud is connected to the spring base and extends around the contact arms and beyond the contact arms. The spring member includes shroud connectors that connect the shroud to the spring base. The shroud connectors extend along the terminal plane.

In another embodiment, this invention relates to an electrical terminal including a contact base and a plurality of contact arms extending from the contact base and arranged on opposed sides of a terminal plane. The electrical terminal also includes a spring member with a spring base and a plurality of spring arms extending from the spring base. Each of the spring arms engages one or more of the contact arms. A shroud is connected to the spring base and extends around the contact arms and beyond the contact arms. The spring member includes shroud connectors that connect the shroud to the spring base. At least two of the shroud connectors are located on opposite sides of the terminal plane.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
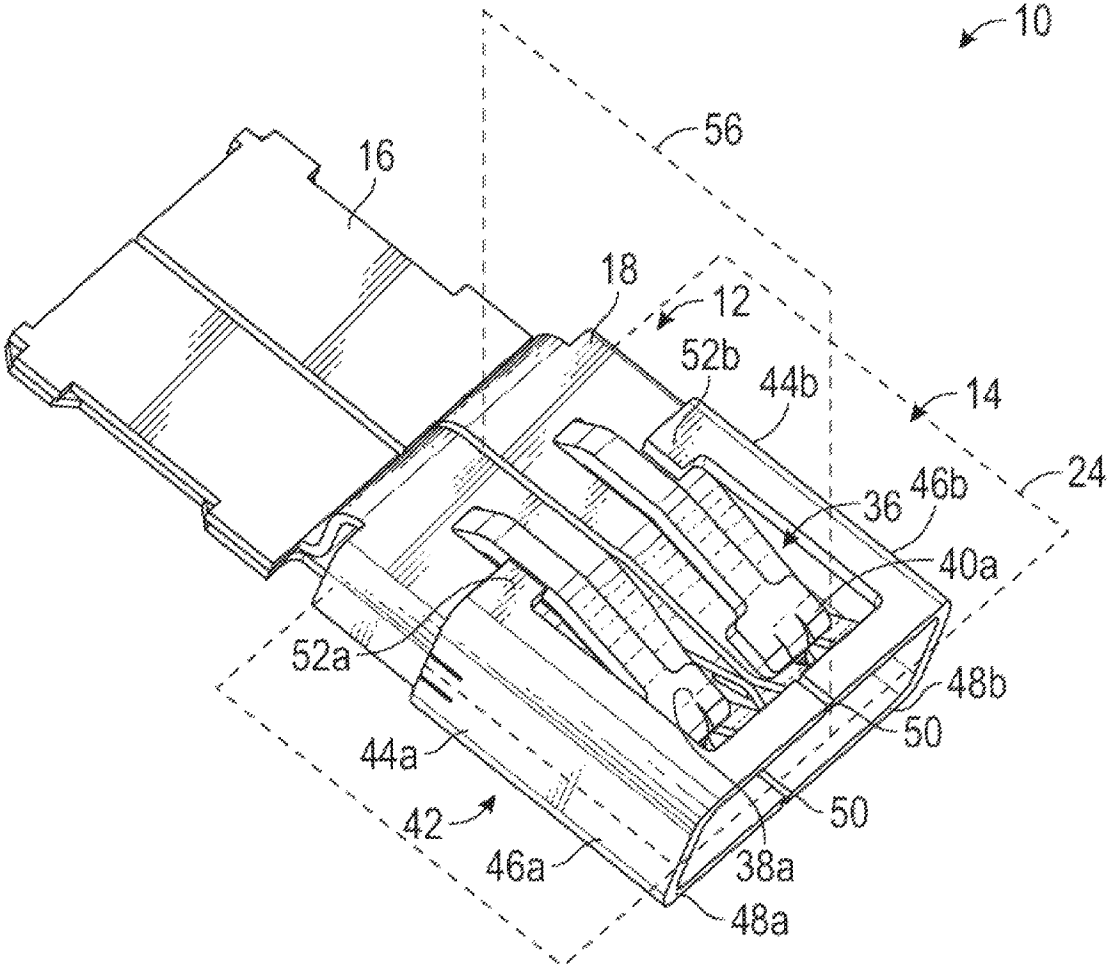
FIG. 1 is a perspective view of a first embodiment of an electric terminal including front end protection in accordance with this invention.
Figure 2:
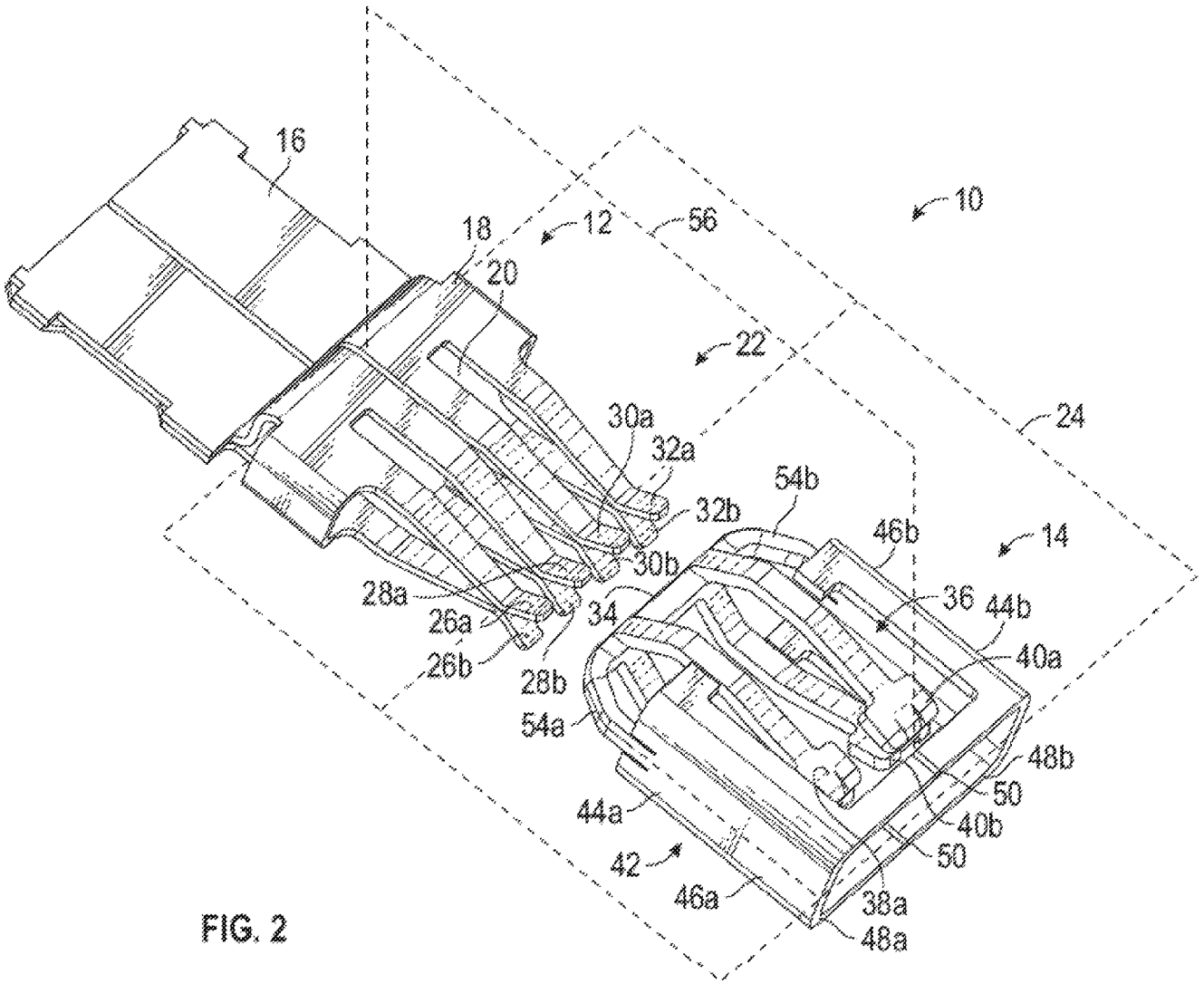
FIG. 2 is an exploded perspective view showing a spring member of the first embodiment of the electric terminal illustrated in FIG. 1 removed from a contact member.
Figure 3:
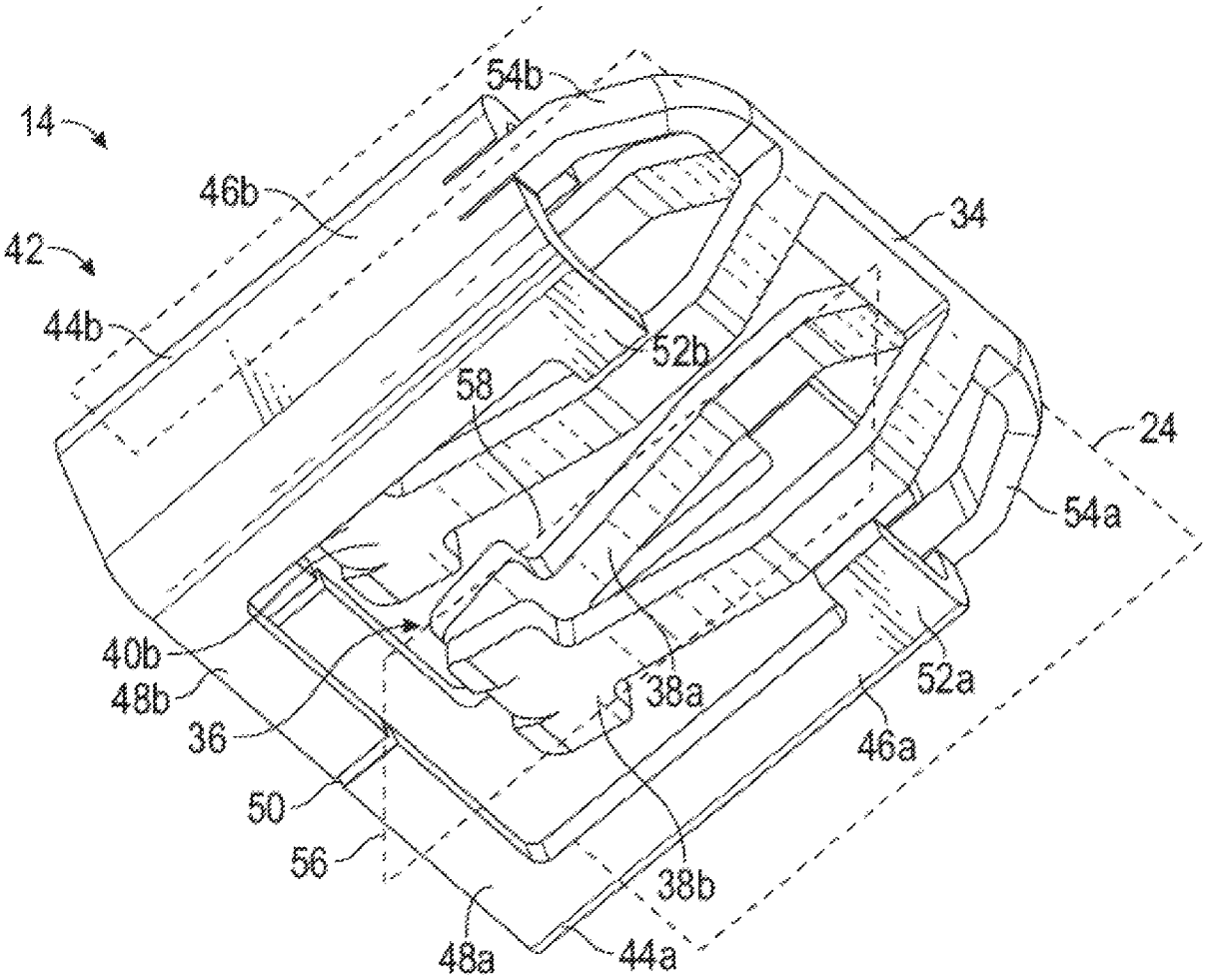
FIG. 3 is a perspective view of the spring member illustrated in FIG. 2 shown from below.

Referring now to the drawings, there is illustrated in FIG. 1 a first embodiment of an electrical terminal assembly, indicated generally at 10, in accordance with this invention. The illustrated electrical terminal assembly 10 is a female electrical terminal, but may be any desired type of terminal. The electrical terminal assembly 10 includes a contact member, indicated generally at 12, and a spring member, indicated generally at 14. FIG. 2 illustrates the electrical terminal assembly 10 with the spring member 14 removed from the contact member 12. FIG. 3 is a perspective view of the spring member 14, taken from below. Details of the electrical terminal assembly 10 will be described in reference to these figures.

The illustrated contact member 12 is made from a single sheet of material, stamped and folded into the illustrated configuration. However, the contact member 12 may be made by any desired process. The illustrated contact member 12 is made of copper, but may be made of any desired material. Preferably, the contact member 12 is made of a material with good electrical conductivity, such as copper or a copper alloy.

The contact member 12 includes a connection portion 16 that is configured to be connected to a conductor such as a wire (not shown). The connection portion 16 may be configured for any desired type of connection. The contact member 12 includes a contact base 18 that is connected to the connection portion 16. The illustrated contact base 18 is a substantially rectangular cross-sectional shaped box that defines an interior space 20. However, the contact base 18 may have any desired shape.

The contact member 12 includes a plurality of contact arms, indicated generally at 22, that extend from the contact base 18. In the illustrated embodiment, the connection portion 16 and the contact arms 22 are located on opposite sides of the contact base 18, but the components may have any desired relative orientations. The contact arms 22 are arranged on opposed sides of a terminal plane 24. In the illustrated embodiment, the contact member 12 includes a total of eight contact arms 22 that are arranged in pairs 26*a* and 26*b*, 28*a* and 28*b*, 30*a* and 30*b*, and 32*a* and 32*b* with one member of each pair located on a first side of the terminal plane 24 while the second member of each pair is located on the second side of the terminal plane 24. However, the contact member 12 may have any desired number and arrangement of contact arms 22.

The electrical terminal assembly 10 is configured to mate with a corresponding terminal (not shown). In the illustrated embodiment, the corresponding terminal is a blade-type male terminal. However, the electrical terminal assembly 10 may be configured to mate with any desired type of corresponding terminal. When the electrical terminal assembly 10 is mated with the corresponding terminal, the corresponding terminal will be located on the terminal plane 24, between the opposed pairs of contact arms 26*a* and 26*b*, 28*a* and 28*b*, 30*a* and 30*b*, and 32*a* and 32*b*.

The illustrated spring member 14 is made from a single sheet of material, stamped and folded into the illustrated configuration. However, the spring member 14 may be made by any desired process. The illustrated spring member 14 is made of stainless steel, but may be made of any desired material. Preferably, the spring member 14 is made of a material with good spring characteristics even at relatively high temperatures.

The spring member 14 includes a spring base 34. In the illustrated embodiment, when the electrical terminal assembly 10 is assembled (as shown in FIG. 1), the spring base 34 is located in the interior space 20 of the contact base 18. Additionally, the illustrated spring base 34 is located on the terminal plane 24. The spring member 14 includes a plurality of spring arms, indicated generally at 36, that extend from the spring base 34. The spring arms 36 are arranged on opposed sides of the terminal plane 24. In the illustrated embodiment, the spring member 14 includes a total of four spring arms 36 that are arranged in pairs 38*a* and 38*b*, and 40*a* and 40*b* with one member of each pair located on a first side of the terminal plane 24 while the second member of each pair is located on the second side of the terminal plane 24. However, the spring member 14 may have any desired number and arrangement of spring arms 36.

When the electrical terminal assembly 10 is assembled, the spring arms 36 extend from the interior space 20 through spaces between the contact arms 22. The spring arms 36 engage the contact arms 22 and bias the contact arms 22 toward the terminal plane 24. In the illustrated embodiment, each spring arm 36 engages two contact arms 22, but the spring arms 36 may engage any desired number of contact arms 22.

The spring member 14 also includes a shroud, indicated generally at 42. When the electrical terminal assembly 10 is assembled, the shroud 42 extends around and beyond the contact arms 22 of the contact member 12 in order to provide side and end protection for the contact arms 22, as is known in the prior art. The illustrated shroud 42 includes two shroud portions 44*a* and 44*b* that are located on opposite sides of the contact arms 22. The first shroud portion 44*a* includes a side shield 46*a* that provides side protection for the contact arms 22 and an end shield 48*a* that is located beyond the contact arms 22. Similarly, the second shroud portion 44*b* includes a side shield 46*b* that provides side protection for the contact arms 22 and an end shield 48*b* that is located beyond the contact arms 22. In the illustrated embodiment, the terminal plane 24 passes through the side shield 46*a* and the side shield 46*b* and the side shields 46*a* and 46*b* extend on each side of the terminal plane 24. However, the side shields 46*a* and 46*b* may be in any desired locations.

In the illustrated embodiment, the first shroud portion 44*a* and the second shroud portion 44*b* are separated from each other by shroud gaps 50. Thus, the shroud 42 is comprised of two separate shroud pieces. The illustrated shroud gaps 50 are spaces between the end shields 48*a* and 48*b* of the respective shroud portions 44*a* and 44*b*, but the shroud gaps 50 may be in any desired location.

The first shroud portion 44*a* includes optional contact retainers 52*a* that engage the contact base 18. The first shroud portion 44*a* includes one contact retainer 52*a* on either side of the terminal plane 24. The second shroud portion 44*b* includes similar contact retainers 52*b*. The contact retainers 52*a* and 52*b* serve to prevent the contact base 18 from being deflected away from the terminal plane 24 when the electrical terminal assembly 10 is mated with the corresponding connector and help maintain the shape of the electrical terminal assembly 10.

The first shroud portion 44*a* is connected to the spring base 34 by a first shroud connector 54*a*. The illustrated first shroud connector 54*a* is an arm that extends from the spring base 34 to the side shield 46*a*. However, the first shroud connector 54*a* may be connected to any desired portion of the first shroud portion 44*a*. The first shroud connector 54*a* is located in the interior space 20 of the contact base 18. In the illustrated embodiment, the first shroud connector 54*a* is located on the terminal plane 24 where it is attached to the spring base 34. Additionally, the illustrated first shroud connector 54*a* is located on the terminal plane 24 where it is attached to the first shroud portion 44*a*. Also, the illustrated first shroud connector 54*a* is located on the terminal plane 24 for the entire span between the spring base 34 and the first shroud portion 44*a*. However, the first shroud connector 54*a* may be in any desired position and have any desired shape.

Similarly, the second shroud portion 44*b* is connected to the spring base 34 by a second shroud connector 54*b*. The illustrated second shroud connector 54*b* is an arm that extends from the spring base 34 to the side shield 46*b*. However, the second shroud connector 54*b* may be connected to any desired portion of the second shroud portion 44*b*. The second shroud connector 54*b* is located in the interior space 20 of the contact base 18. In the illustrated embodiment, the second shroud connector 54*b* is located on the terminal plane 24 where it is attached to the spring base 34. Additionally, the illustrated second shroud connector 54*b* is located on the terminal plane 24 where it is attached to the second shroud portion 44*b*. Also, the illustrated second shroud connector 54*b* is located on the terminal plane 24 for the entire span between the spring base 34 and the second shroud portion 44*b*. However, the second shroud connector 54*b* may be in any desired position and have any desired shape.

As can be seen by comparing FIGS. 2 and 3, the spring member 14 is symmetrical across the terminal plane 24. The part of the spring member 14 on one side of the terminal plane 24 is a mirror image of the part of the spring member 14 on the other side of the terminal plane 24. Additionally, the spring member 14 is symmetrical across a cross plane 56 that is perpendicular to the terminal plane 24 and passes through the shroud gaps 50. Also, the spring member 14 is rotationally symmetric if rotated 180° around an intersection line 58 of the terminal plane 24 and the cross plane 56.

In order to assemble the electrical terminal assembly 10, the spring member 14 is positioned relative to the contact member 12 on the terminal plane 24 with the spring arms 36 and the contact arms 22 pointing away from the contact base 18, as shown in FIG. 2. The spring member 14 is moved relative to the contact member 12 toward the contact base 18 so that the spring base 34 passes between the contact arms 22 and into the interior space 20 of the contact base 18. As a result of the symmetrical design of the spring member 14, it does not have an "up" side or a "down" side and may be placed in either initial orientation relative to the contact member 12.

As the electrical terminal assembly 10 is mated with the corresponding terminal, the contact arms 22 are deflected away from the terminal plane 24 and move relative to the contact base 18. Also, the spring arms 36 are deflected away from the terminal plane 24 and move relative to the spring base 34. Because the spring base 34 is located on the terminal plane 24 and the spring arms 36 are arranged symmetrically across the terminal plane 24, there will be little movement of the spring base 34 caused by mating the electrical terminal assembly 10 with the corresponding terminal. Thus, there will be little movement of the spring base 34 and the attached shroud 42 relative to the contact member 12, and little to no load will be placed on the shroud 42 caused by mating the electrical terminal assembly 10 with the corresponding terminal.

Figure 4:
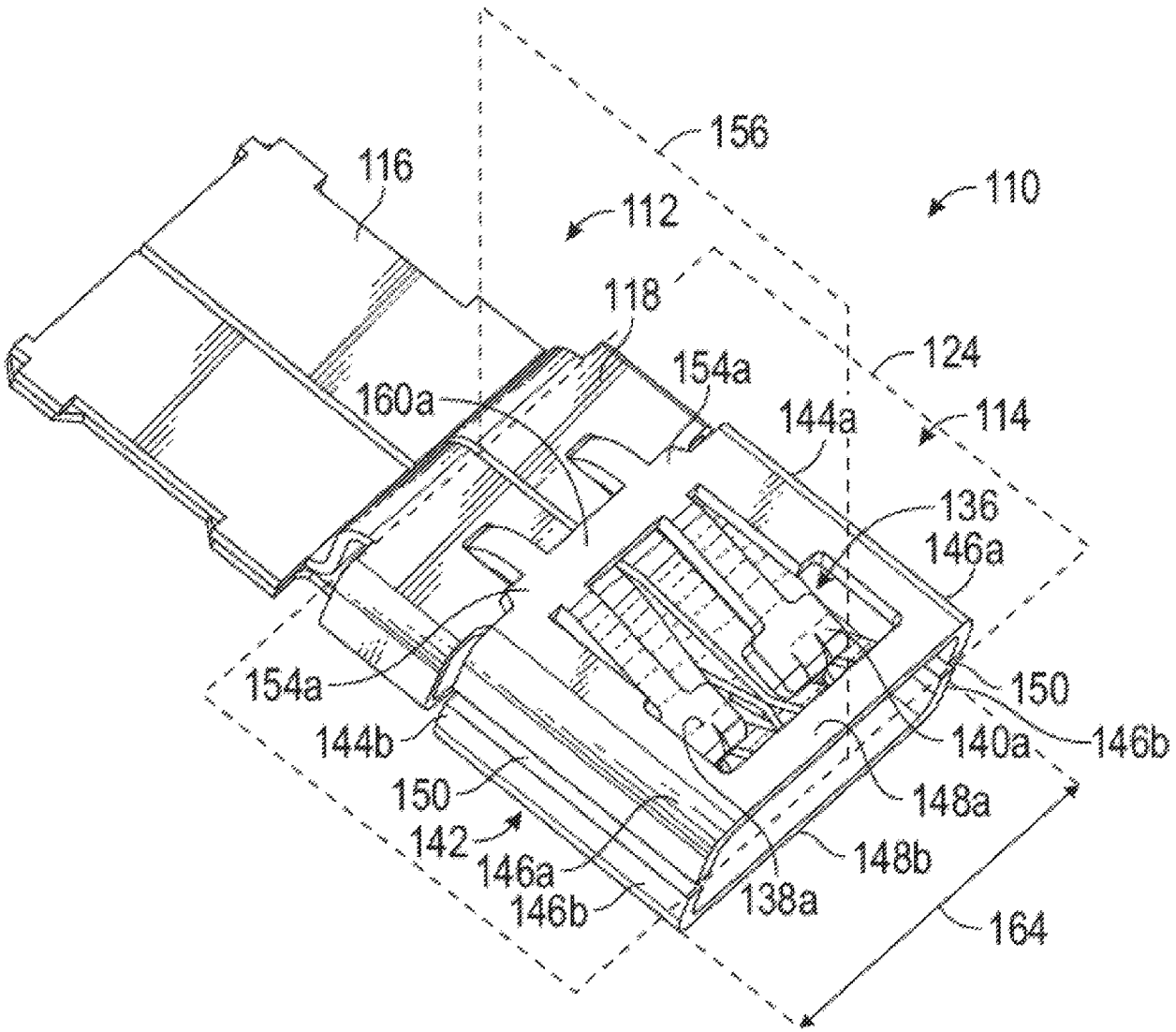
FIG. 4 is a perspective view of a second embodiment of an electric terminal including front end protection in accordance with this invention.
Figure 5:
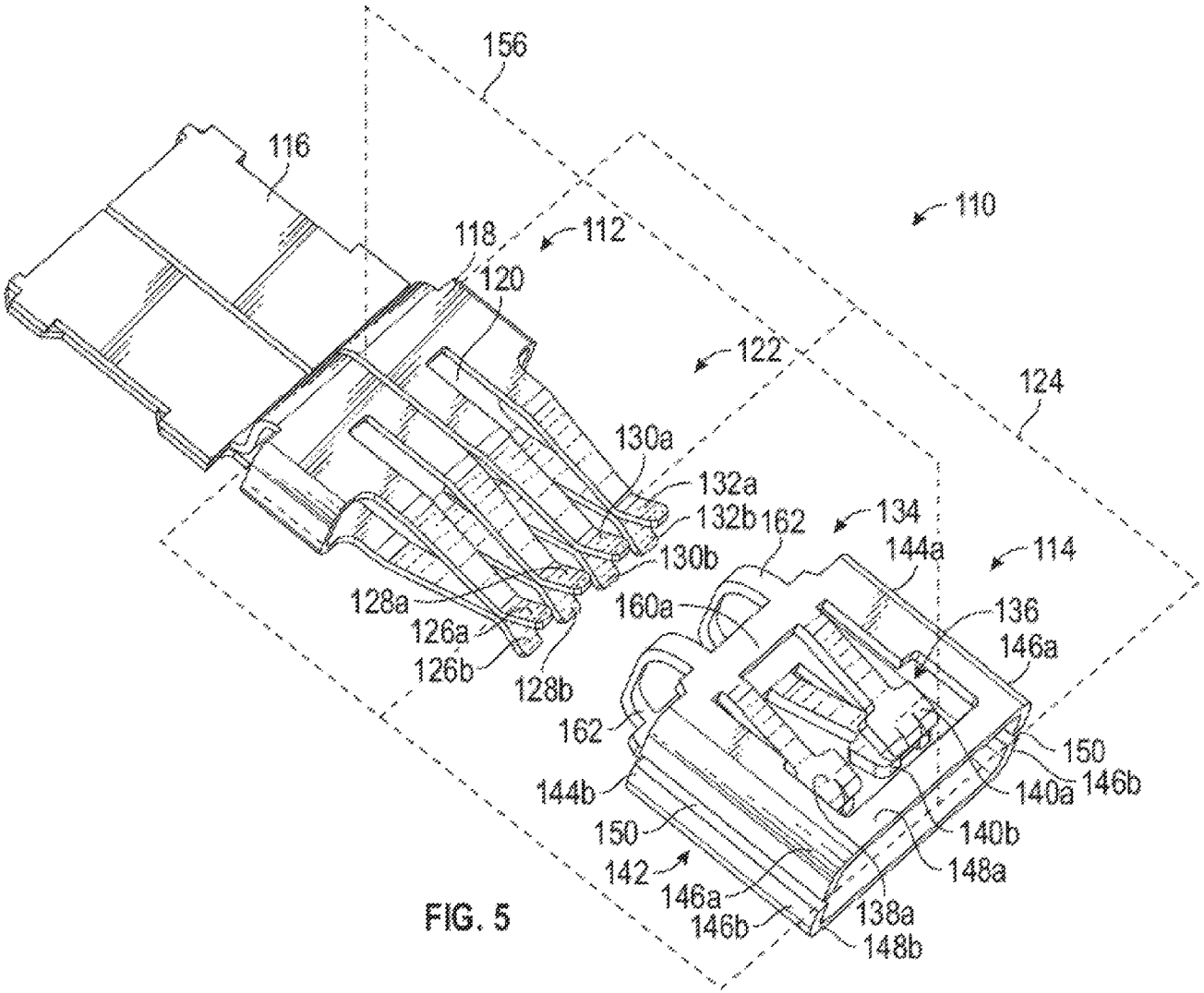
FIG. 5 is an exploded perspective view showing a spring member of the second embodiment of the electric terminal illustrated in FIG. 4 removed from a contact member.
Figure 6:
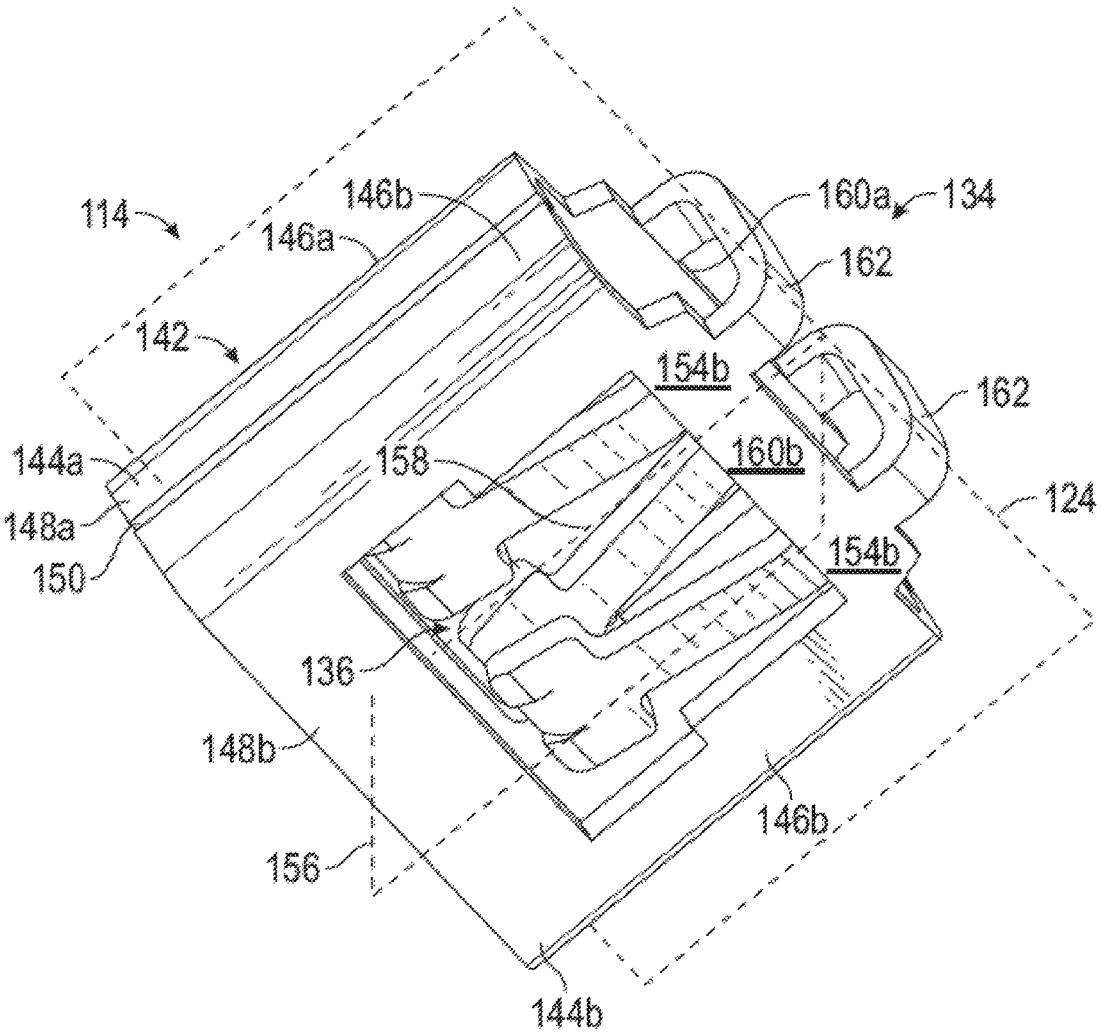
FIG. 6 is a perspective view of the spring member illustrated in FIG. 5 shown from below.

Referring to FIG. 4, there is illustrated a perspective view of a second embodiment of an electrical terminal assembly, indicated generally at 110, in accordance with this invention. The illustrated electrical terminal assembly 110 is a female electrical terminal, but may be any desired type of terminal. The electrical terminal assembly 110 includes a contact member, indicated generally at 112, and a spring member, indicated generally at 114. FIG. 5 illustrates the electrical terminal assembly 110 with the spring member 114 removed from the contact member 112. FIG. 6 is a perspective view of the spring member 114, taken from below. Details of the electrical terminal assembly 110 will be described in reference to these figures.

The illustrated contact member 112 is substantially the same as the previously described contact member 12 and, thus, will not be described in detail. Elements of the contact member 112 that are similar to elements on the contact member 12 will be identified using the same number increased by 100. However, the electrical terminal assembly 110 may include a contact member 112 that is different from that previously described, if desired. Additionally, the electrical terminal assembly 110 is configured to mate with a corresponding terminal (not shown) that is located on a terminal plane 124. In the illustrated embodiment, the corresponding terminal is a blade-type male terminal, but may be any desired type of corresponding terminal.

The illustrated spring member 114 made from a single sheet of material, stamped and folded into the illustrated configuration. However, the spring member 114 may be made by any desired process. The illustrated spring member 114 is made of stainless steel, but may be made of any desired material. Preferably, the spring member 114 is made of a material with good spring characteristics even at relatively high temperatures.

The spring member 114 includes a spring base, indicated generally at 134. The illustrated spring base 134 includes a first outer base 160*a* and a second outer base 160*b* that are spaced apart from each other and are each connected to base connectors 162. When the electrical terminal assembly 110 is assembled (as shown in FIG. 4), the first outer base 160*a* is located adjacent one side of a contact base 118 of the contact member 112, and the second outer base 160*b* is located adjacent an opposed side of the contact base 118. The base connectors 162 extend through spaces between contact arms 122 and through an interior space 120 defined by the contact base 118. However, the spring base 134 may have any desired shape and component.

The spring member 114 includes a plurality of spring arms, indicated generally at 136, that extend from the spring base 134. The spring arms 136 are arranged on opposed sides of the terminal plane 124. In the illustrated embodiment, the spring member 114 includes a total of four spring arms 136 that are arranged in pairs 138*a* and 138*b*, and 140*a* and 140*b* with one member of each pair located on a first side of the terminal plane 124 while the second member of each pair is located on the second side of the terminal plane 124. However, the spring member 114 may have any desired number and arrangement of spring arms 136. The spring arms 138*a* and 140*a* extend from the first outer base 160*a*, and the spring arms 138*b* and 140*b* extend from the second outer base 160*b*.

When the electrical terminal assembly 110 is assembled, the spring arms 136 engage the contact arms 122 and bias the contact arms 122 toward the terminal plane 124. In the illustrated embodiment, each spring arm 136 engages two contact arms 122, but the spring arms 136 may engage any desired number of contact arms 122.

The spring member 114 also includes a shroud, indicated generally at 142. When the electrical terminal assembly 110 is assembled, the shroud 142 extends around and beyond the contact arms 122 of the contact member 112 in order to provide side and end protection for the contact arms 122, as is known in the prior art. The illustrated shroud 142 includes two shroud portions 144*a* and 144*b* that are located on opposite sides of the contact arms 122. The first shroud portion 144*a* includes two side shields 146*a* that provide side protection for the contact arms 122 and an end shield 148*a* that is located beyond the contact arms 122. Similarly, the second shroud portion 144*b* includes two side shields 146*b* that provide side protection for the contact arms 122 and an end shield 148*b* that is located beyond the contact arms 122.

In the illustrated embodiment, the first shroud portion 144*a* and the second shroud portion 144*b* are separated from each other by shroud gaps 150. Thus, the shroud 142 is comprised of two separate shroud pieces. The illustrated shroud gaps 150 are spaces between the side shields 146*a* and 146*b*. The first shroud portion 144*a* and the second shroud portion 144*b* are separated from each other by two shroud gaps 150, one at each side of the shroud 142. In the illustrated embodiment, the terminal plane 124 passes through the shroud gaps 150 at either end of the shroud 142, and the first shroud portion 144*a* and the second shroud portion 144*b* are located on opposite sides of the terminal plane 124. However, the shroud portions 144*a* and 144*b* may be in any desired locations.

The first shroud portion 144*a* is connected to the spring base 134 by first shroud connectors 154*a*. The illustrated first shroud connectors 154*a* are arms that extend from the first outer base 160*a* to the side shields 146*a*. However, the first shroud connectors 154*a* may be connected to any desired portion of the first shroud portion 144*a*, may be in any desired position, and have any desired shape.

Similarly, the second shroud portion 144*b* is connected to the spring base 134 by second shroud connectors 154*b*. The illustrated second shroud connectors 154*b* are arms that extend from the second outer base 160*b* to the side shields 146*b*. However, the second shroud connectors 154*b* may be connected to any desired portion of the second shroud portion 144*b*, may be in any desired position, and have any desired shape.

As can be seen by comparing FIGS. 5 and 6, the spring member 114 is symmetrical across the terminal plane 124. The part of the spring member 114 on one side of the terminal plane 124 is a mirror image of the part of the spring member 114 on the other side of the terminal plane 124. Additionally, the spring member 114 is symmetrical across a cross plane 156 that is perpendicular to the terminal plane 124 and passes through the center of the spring base 134. Also, the spring member 114 is rotationally symmetric if rotated 180° around an intersection line 158 of the terminal plane 124 and the cross plane 156.

In order to assemble the electrical terminal assembly 110, the spring member 114 is positioned relative to the contact member 112 on the terminal plane 124 with the spring arms 136 and the contact arms 122 pointing away from the contact base 118, as shown in FIG. 5. The spring member 114 is moved relative to the contact member 112 toward the contact base 118 so that the base connectors 162 are positioned between the contact arms 122 and at least partially in the interior space 120 of the contact base 118. As a result of the symmetrical design of the spring member 114, it does not have an "up" side or a "down" side and may be placed in either initial orientation relative to the contact member 112.

When the electrical terminal assembly 110 is mated with the corresponding terminal, the contact arms 122 are deflected away from the terminal plane 124 and move relative to the contact base 118. Also, the spring arms 136 are deflected away from the terminal plane 124 and move relative to the spring base 134. Because the spring member 114 is arranged symmetrically across the terminal plane 124, there will be little movement of the spring base 134 caused by mating the electrical terminal assembly 110 with the corresponding terminal. Thus, there will be little movement of the spring base 134 and the attached shroud 142 relative to the contact member 112, and little to no load will be placed on the shroud 142 caused by mating the electrical terminal assembly 110 with the corresponding terminal.

The shroud 142 defines a terminal span 164, which is the length of the space between the side shields 146*a* on either end of the first shroud portion 144*a* and is also the length of the space between the side shields 146*b* on either end of the second shroud portion 144*b*. A wide terminal that is wider than the terminal span 164 will engage one or both of the side shields 146*a* and 146*b* of the shroud 142 when mated with the electrical terminal assembly 110. In a conventional electrical terminal with a shroud, such as that shown in U.S. Pat. No. 9,548,553 discussed above, the wide terminal will engage the shroud and be unable to mate with the contact arms. However, in the illustrated electrical terminal assembly 110, the shroud gaps 150 are located on the terminal plane 124 and allow for mating with the wide terminal. The wide terminal may either enter the shroud gaps 150 without engaging the shroud 142, or may engage the shroud 142 in order to push the first shroud portion 144*a* and the second shroud portion 144*b* away from the terminal plane 124.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A female electrical terminal assembly that is configured to mate with a blade-type male terminal comprising:

a contact member including a contact base and a plurality of opposed pairs of contact arms extending from the contact base, each of the opposed pairs of contact arms including first and second contact arms arranged on opposed sides of a terminal plane so as to be configured to mate with a blade-type male terminal extending therebetween;

a spring member including a spring base, a plurality of spring arms extending from the spring base and engaging one or more of the opposed pairs of contact arms, and a shroud that is connected to the spring base and extends around the contact arms and beyond the contact arms, the spring member being symmetrical across the terminal plane.

2. The female electrical terminal assembly of claim 1, wherein the shroud includes a first shroud portion that is separated from a second shroud portion by two shroud gaps.

3. The female electrical terminal assembly of claim 2, wherein the terminal plane passes through the shroud gaps.

4. The female electrical terminal assembly of claim 2, wherein the terminal gaps are located on opposite sides of the contact arms.

5. The female electrical terminal assembly of claim 2, wherein the first shroud portion includes a first side shield and the second shroud portion includes a second side shield, and wherein the terminal plane passes through the first side shield and the second side shield.

6. The female electrical terminal assembly of claim 1, wherein the contact base defines an interior space, and wherein the spring base is located in the interior space.

7. The female electrical terminal assembly of claim 1, wherein the shroud is connected to the spring base by first and second shroud connectors that are each located on the terminal plane for an entire span between the spring base and the shroud.

8. A female electrical terminal assembly that is configured to mate with a blade-type male terminal comprising:

a contact member including a contact base and a plurality of opposed pairs of contact arms extending from the contact base, each of the opposed pairs of contact arms including first and second contact arms arranged on opposed sides of a terminal plane so as to be configured to mate with a blade-type male terminal extending therebetween;

a spring member including a spring base, a plurality of spring arms extending from the spring base and engaging one or more of the opposed pairs of contact arms, and a shroud that is connected to the spring base and extends around the contact arms and beyond the contact arms;

the spring member including first and second shroud connectors that connect the shroud to the spring base, each of the first and second shroud connectors extending along the terminal plane for an entire span between the spring base and the shroud.

9. The female electrical terminal assembly of claim 8, wherein the spring member is symmetrical across the terminal plane.

10. The female electrical terminal assembly of claim 8, wherein the shroud includes a first shroud portion that is separated from a second shroud portion by two shroud gaps.

11. The female electrical terminal assembly of claim 10, wherein the shroud gaps are located on opposed sides of the terminal plane.

12. The female electrical terminal assembly of claim 10, wherein the first shroud portion includes a first side shield and the second shroud portion includes a second side shield and the terminal plane passes through the first side shield and the second side shield.

13. The female electrical terminal assembly of claim 8 wherein the contact base defines an interior space, and wherein the spring base is located in the interior space.

14. The female electrical terminal assembly of claim 13, wherein the shroud connectors are located in the interior space.

15. A female electrical terminal assembly that is configured to mate with a blade-type male terminal comprising:

a contact member including a contact base and a plurality of opposed pairs of contact arms extending from the contact base, each of the opposed pairs of contact arms including first and second contact arms arranged on opposed sides of a terminal plane so as to be configured to mate with a blade-type male terminal extending therebetween;

a spring member including a spring base, a plurality of spring arms extending from the spring base and engaging one or more of the opposed pairs of contact arms, and a shroud that is connected to the spring base and extends around the contact arms and beyond the contact arms;

the shroud including a first shroud portion and a second shroud portion that are located on opposite sides of the terminal plane and are separated from each other by first and second shroud gaps.

16. The female electrical terminal assembly of claim 15, wherein the terminal plane passes through the first and second shroud gaps.

17. The female electrical terminal assembly of claim 15, wherein the spring base includes first and second outer bases, and wherein the plurality of spring arms extends from the first and second outer bases.

18. The female electrical terminal assembly of claim 17, wherein the first and second outer bases are connected together by first and second base connectors.

19. The female electrical terminal assembly of claim 18, wherein the contact base defines an interior space, and wherein the first and second base connectors extend through the interior space.

* * * * *